US007337557B2

(12) United States Patent
Miyata

(10) Patent No.: US 7,337,557 B2
(45) Date of Patent: Mar. 4, 2008

(54) AIR-PERMEABLE SHOE

(75) Inventor: Yoshiaki Miyata, Osaka (JP)

(73) Assignee: Miyata Co., Ltd., Osaka (JP)

( * ) Notice: Subject to any disclaimer, the term of this patent is extended or adjusted under 35 U.S.C. 154(b) by 232 days.

(21) Appl. No.: 11/197,218

(22) Filed: Aug. 3, 2005

(65) Prior Publication Data

US 2007/0028483 A1 Feb. 8, 2007

(30) Foreign Application Priority Data

May 20, 2005 (JP) ..... 2005-148781

(51) Int. Cl.
*A43B 7/08* (2006.01)

(52) U.S. Cl. ..... 36/3 B

(58) Field of Classification Search ..... 36/3 B, 36/3 R, 3 A, 29, 28
See application file for complete search history.

(56) References Cited

U.S. PATENT DOCUMENTS 2,098,412 A * 11/1937 Bovay ..... 36/3 R
2,344,762 A * 3/1944 Wylie ..... 36/3 B
5,400,526 A * 3/1995 Sessa ..... 36/3 B
5,815,949 A * 10/1998 Sessa ..... 36/3 B
6,948,260 B2 * 9/2005 Lin et al. ..... 36/3 B

FOREIGN PATENT DOCUMENTS

| | | |
|---|---|---|
| JP | 03-236801 | 10/1991 |
| JP | 3037474 | 2/1997 |
| JP | 3080904 | 7/2001 |
| JP | 2002-345503 | 12/2002 |
| JP | 3100359 | 12/2003 |
| WO | WO- 9966812 | 12/1999 |

* cited by examiner

*Primary Examiner*—Ted Kavanaugh
(74) *Attorney, Agent, or Firm*—Jordan and Hamburg LLP

(57) ABSTRACT

On the upper surface of a lower sole transverse grooves reaching the lateral surface of the sole are formed, and an upper sole in which a recess is formed is stacked on the lower sole. In the recess, an elastic block body is fitted so that the upper portions of the block body protrude above the upper surface of the upper sole. On the upper surface of the lower sole, an air-permeable support sheet is disposed so as to support the block body in the recess. The shoe interior and tranverse grooves communicate with one another through the vertical holes in the block body and the support sheet, and when a load is applied to the block body, the vertical holes deform, causing air to flow in and out through the tranverse grooves.

5 Claims, 3 Drawing Sheets

AIR-PERMEABLE SHOE

TECHNICAL FIELD

The present invention relates to an air-permeable shoe with higher air permeability within the shoe.

BACKGROUND OF THE INVENTION

When a foot perspires, the shoe interior can grow humid. To prevent this, air permeability within a shoe can be improved. For example, a shoe of Laid-open Japanese Patent Application H3-236801 is configured such that a sole is made partly hollow to form a recess, vent grooves communicating from the recess to the lateral surfaces of the sole are formed, and air-permeable objects are accommodated in the recess. Humidity accumulated in the recess is discharged from the vent grooves by a pumping action induced during walking.

Also, a shoe of Japanese Utility Model Registration No. 3080904 is configured such that on the sole upper surface, an elastic tube is provided, a conduit is connected to one end of the tube, and the conduit extends to the lateral surfaces of the sole. On the tube, vent holes are provided so that when the tube is pressed, air flows in and out of the tube.

With a constitution as in Laid-open Japanese Patent Application H3-236801, sufficient pumping action cannot be attained, so air inside the shoe is not discharged. With a constitution as in Japanese Utility Model Registration No. 3080904, because a tube is disposed from the toe tip to the heel, the position at which a load is applied with respect to the tube changes during walking. When the undersurface of a foot separates from the tube, air inside the tube is discharged from sections on which no load is applied into the shoe interior, so that no air is discharged outside of the shoe. Thus, both patents are insufficient for ventilating the shoe interior, and have inferior air permeability.

SUMMARY OF THE INVENTION

In view of the above, it is an object of the present invention to provide an air-permeable shoe with higher air permeability by facilitating air inflow and outflow.

The present invention is configured such that a recess is formed on the sole upper surface, transverse grooves are formed on the recess bottom surface, the transverse grooves communicate with vent holes formed on the lateral surfaces of the sole, an elastic block body is fitted in the recess, the upper portions of the block body protrude above the sole upper surface, vertical holes are formed in the block body, on the recess bottom surface, a support sheet is provided so that when a load is applied, entry of the block body into the transverse grooves is prevented, the support sheet is air permeable, and the shoe interior and transverse grooves communicate with one another through the vertical holes and support sheet.

The sole has a two-layer structure comprising an upper sole and lower sole. Transverse grooves are formed on the upper surface of the lower sole, and the transverse grooves reach the lateral surfaces of the lower sole. On the upper sole, a recess penetrating so as to reach the lower sole is formed. The lower sole and upper sole are stacked, and the transverse grooves are covered with the upper sole, thereby forming vent holes.

Further, the sole has a two-layer structure comprising an outsole in which the upper surface is formed in a depressed shape to form peripheral walls on the peripheral edges, and a midsole is fitted in the recess. Transverse grooves are formed on the outsole upper surface, and the transverse grooves penetrate the peripheral walls to serve as vent holes reaching the lateral surfaces of the sole. On the midsole, a recess penetrating so as to reach the outsole is formed. The outsole and midsole are stacked, so that the transverse grooves are covered by the midsole.

When a load is applied to the block body, the vertical holes deform, causing air to flow in and out between the vent holes and shoe interior. More specifically, during walking, a foot steps on the block body and separates therefrom. Because the block body protrudes above the sole, a load is intensively applied, thereby making a great change to the load applied to the block body. Because the block body is fitted in the recess, when a load is applied to the block body, the block body is not able to expand, causing the vertical holes to deform. The capacity of the vertical holes lowers, and air inside the vertical holes is pushed out. Air flows out from the vent holes through the support sheet and transverse grooves to the outside of the shoe. When the load applied to the block body decreases, the block body is restored to its original state, increasing the capacity of the vertical holes. At this time, air around the vertical holes is drawn in, causing air outside and inside of the shoe to flow in. Also, when a load is applied to the block body, the block body is pressed down and held by the support sheet. Therefore, the lower portions of the block body deform, preventing entry of the block body into the transverse grooves.

A plurality of transverse grooves are formed so as to intersect with one another, and a vent path is formed in the horizontal direction within the support sheet so that a plurality of vertical holes and transverse grooves communicate with one another. Even when the positions of the vertical holes and the positions of the transverse grooves do not match, air flows between the vertical holes and transverse grooves through the support sheet.

The recess has a set size regardless of the sole size, and the block body has a set shape corresponding to the recess. Even for sole with different sizes, a block body with the same shape can be used.

With the present invention, when the block body is stepped on during waking, the vertical holes greatly deform, causing air to flow in and out through the transverse grooves. As a result, air inside the shoe is discharged to the outside, and outside air flows in, thereby efficiently ventilating the shoe interior.

Figure 1:
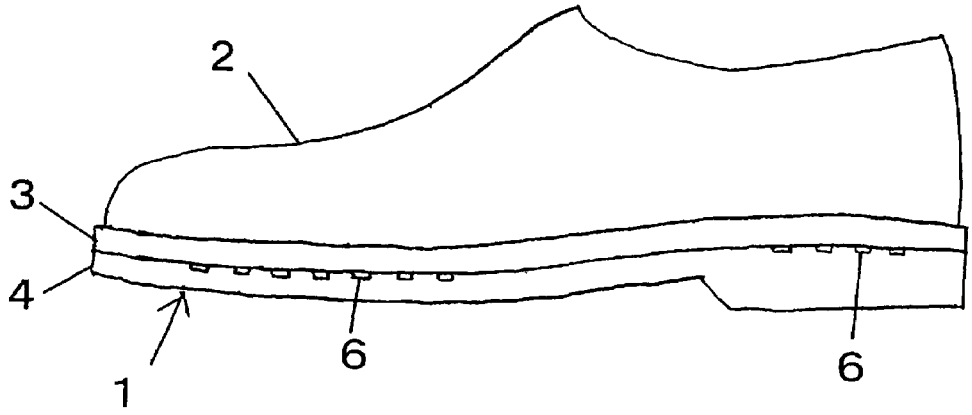
FIG. 1 illustrates a side view of an air-permeable shoe of the present invention.
Figure 2:
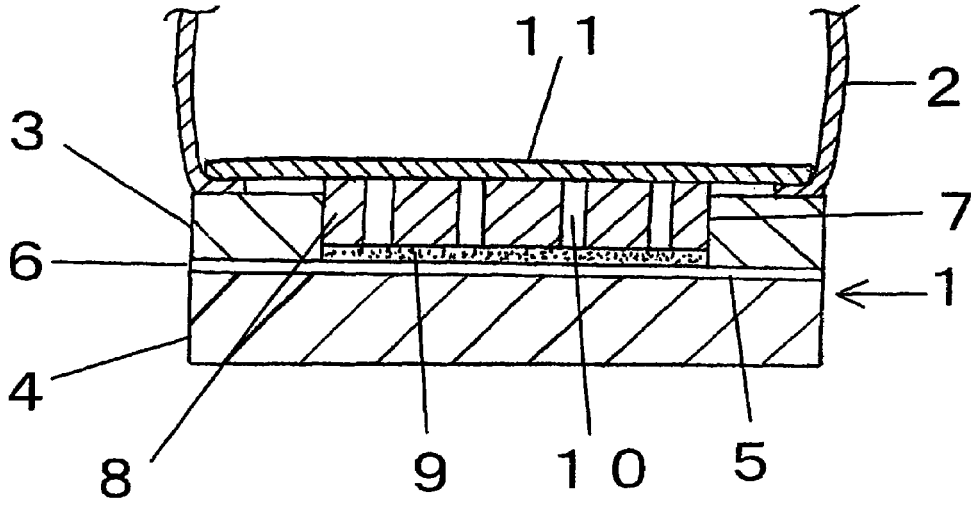
FIG. 2 illustrates a transverse cross-sectional view of a sole.
Figure 3:
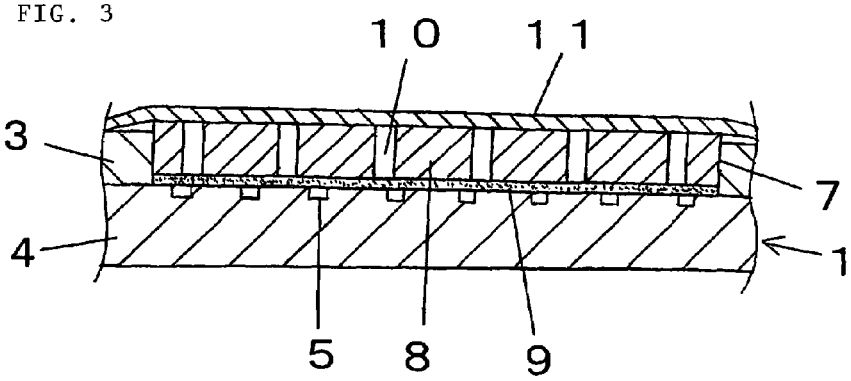
FIG. 3 illustrates a vertical cross-sectional view of a sole.

BEST MODE FOR CARRYING OUT THE INVENTION:

An air-permeable shoe of the present embodiment is shown in FIG. 1. The air-permeable shoe comprises a sole 1 and upper 2. As shown in FIGS. 2 and 3, the sole 1 has a two-layer structure comprising an upper sole 3 and lower sole 4. The upper sole 3 and lower sole 4, which are both made of rubber, are joined. The upper 2 is joined with an adhesive to or is sewn on the upper surface of the upper sole 3 so as to be integrally attached to the sole 1.

Figure 4:
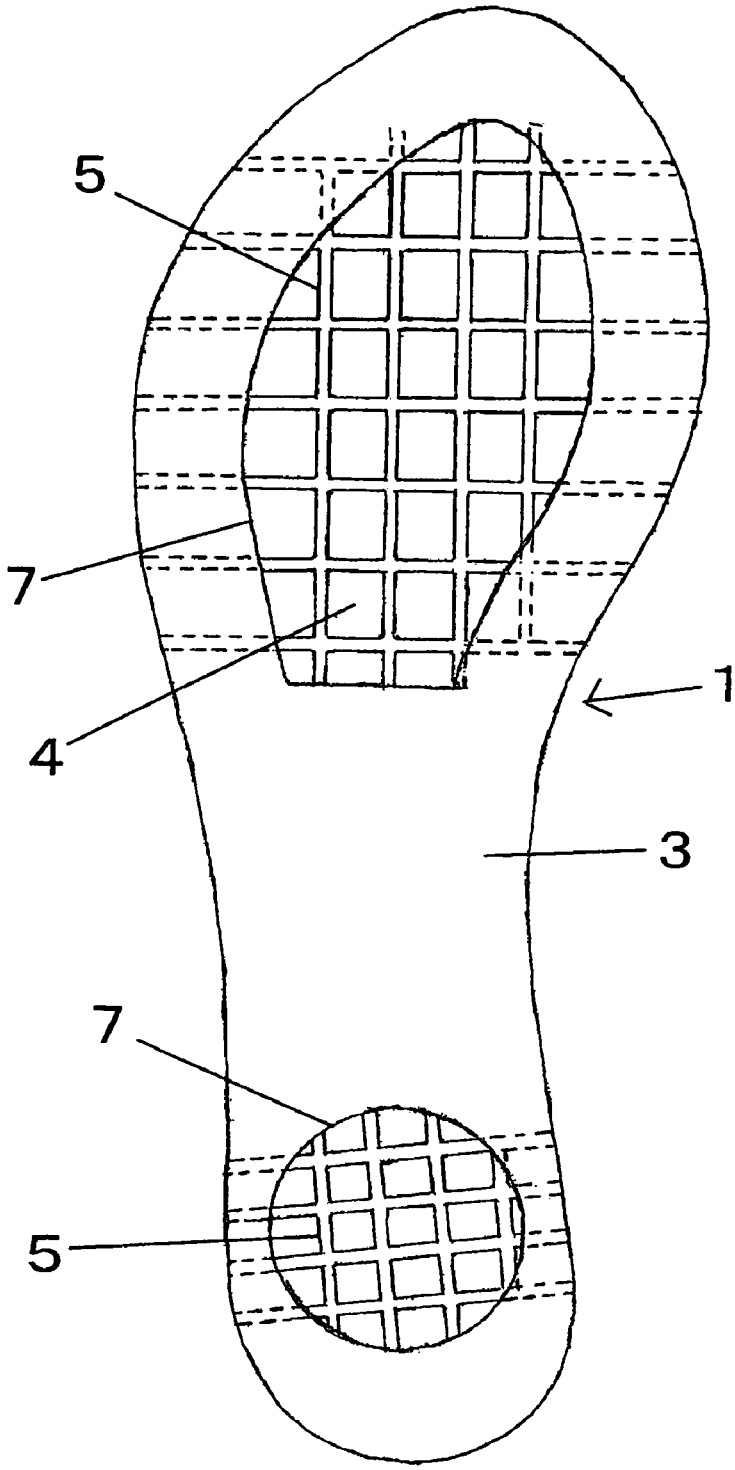
FIG. 4 illustrates a plan view of a sole in a state where block body has been removed.

As shown in FIG. 4, transverse grooves 5 are provided on the upper surface of the lower sole 4. The transverse grooves 5 are formed in the front and back direction and right and left direction so that the transverse grooves 5 in the right and left direction intersect with the transverse grooves 5 in the front and back direction and the plurality of transverse grooves 5 communicate with one another. The transverse grooves 5 in the right and left direction reach the lateral surfaces of the lower sole 4, thereby forming, as shown in FIG. 1, vent holes 6 of the lateral surfaces of the sole 1.

The transverse grooves 5 are disposed on both the toe tip side and heel side of the lower sole 4, where the undersurface of a foot presses down. In correspondence thereto, the toe tip side and heel side of the upper sole 3 are both made partially hollow, and the upper sole 3 is stacked on the lower sole 4, thereby forming recesses 7. The toe tip side recess 7 is formed in a shape so as to conform to the contour of the sole 1, and the heel side recess 7 is formed in a circular shape. The lower sole 4 upper surface serves as the bottom surface for the recesses 7 , the transverse grooves 5 are exposed in the recess 7, the transverse grooves 5 toward the lateral surfaces are partly covered with the upper sole 3, thereby forming the vent holes 6.

In the recesses 7, as shown in FIGS. 2 and 3, block body 8 and a support sheet 9 are provided. The block body 8 is made of an elastic material such as a rubber or elastomer, and is formed so as to conform to the shape of the recess 7. The block body 8 is configured so that it has the same size as that of the recess 7, and is fitted in the recess 7. In the block body 8, a plurality of vertical holes are formed so as to penetrate the block body 8 in the vertical direction. The vertical holes 10 are equidistantly arranged in a regular manner. Alternatively, the vertical holes 10 may be arranged in a random manner.

The support sheet 9 is an air-permeable sheet formed in the same shape as the recess 7. The support sheet 9 are fitted in the recess 7 and disposed between the lower sole 4 and block body 8. The support sheet 9 receives the block body 8 so that the block body 8 does not enter the transverse grooves 5.

The support sheet 9 has a three-dimensional structure in which an outer material and lining made of synthetic fibers are connected by a plurality of threads made of synthetic fibers, and is elastic with respect to a load in the vertical direction. When a vertical load is applied to the support sheet 9, the support sheet 9 disperses the pressure and is compressed. At this time, the lower surface of the support sheet 9 does not locally sink, so there is no covering of the transverse grooves 5.

In the outer material and lining, a large number of micro pores are formed, and the support sheet 9 interior has a net-like structure, thereby forming space connected not only in the vertical direction but also in the horizontal direction. In such support sheet 9, air circulates in the vertical direction and horizontal direction. Therefore, due to the presence of the support sheet 9 between the lower sole 4 and block body 8, even when the positions of the vertical holes 10 in the block body 8 and the positions of the transverse grooves 5 do not match, air circulates between the vertical holes 10 and transverse grooves 5. As a result, a vent path is formed from the shoe interior through the vertical holes 10, support sheet 9 and transverse grooves 5 to the vent holes 6.

The upper portions of block body 8 protrude above the upper surface of the upper sole 3. The height of the protrusion is set at 1-2 mm. Above the upper sole 3, an insole 11 is disposed to cover the flat upper surfaces of the block body 8. The insole 11 is made of thin rubber, leather or the like, comprises micro pores, and is air permeable.

When a user puts on the above air-permeable shoe, a foot, via the insole 11, steps on the block body 8 protruding above the sole 1. When a user walks, the foot first presses the heel side block body 8, and then presses the toe tip side block body 8. When a load is applied to the block body 8 from above, the block body 8 deforms so as to expand in the horizontal direction; however, because of the wall surfaces of the recess 7, this expansion is restricted. As a result, the vertical holes 10 deform, being squashed, lowering the capacity of the vertical holes 10. Because the upper sides of the vertical holes 10 are covered by the foot, air in the vertical holes 10 is pressed out downwardly. Air flows from the support sheet 9 into the transverse grooves 5, and is discharged from the vent holes 6 to the outside of the shoe. When the foot separates from the sole 1 upper surface, no load is applied to the block body 8, and the vertical holes 10 return to their original state due to elasticity. The capacity of the vertical holes 10 increases, outside air is drawn in through the transverse grooves 5, and air in the shoe is also drawn in. Through repetition of such action, air flows in and out between outside and inside of the shoe, thereby ventilating the shoe interior.

Here, if the block body 8 does not protrude above the sole 1, for example, if the height of the block body 8 is same as the upper sole 3 surface, not only the block body 8 but also the upper sole 3 is pressed by a foot. Due to this, a load is dispersed, and the load applied to the block body 8 decreases. Compared to a case where the block body 8 does protrude, the vertical holes 10 deform less, and sufficient pushing-out action and drawing-in action are not achieved. On the other hand, when the block body 8 protrudes above the sole 1, a load is intensively applied to the block body 8. Thus, sufficient pushing-out action and drawing-in action are achieved, improving air permeability.

Because the elastic block body 8 easily deforms, if there is no support sheet 9, when a load is applied to the block body 8, the block body 8 on being squashed will enter into the transverse grooves 5, covering the transverse grooves 5. By providing the support sheet 9, even when a load is applied, the lower surfaces of the block body 8 are held, preventing the block body 8 from entering the transverse grooves 5 and securing the vent path.

By configuring the sole 1 in a two-layer structure, after the transverse grooves 5 are formed on the lower sole 4 upper surface, the upper sole 3 can be bonded thereto, facilitating the formation of vent holes. Thus, the transverse grooves 5 can be freely formed in such shapes as a line, curve, wave, circle or polygon.

The recesses 7 have a set size regardless of the size of the sole 1. In correspondence thereto, the block body 8 and support sheet 9 have a set size as well. It is sufficient that only one type of block body 8 and support sheet 9 be prepared for purposes of universality and making these suitable for mass production. Further, when the block body 8 is fitted in, there is no possibility of using the wrong block body 8. Thus, the work is simple, involving only the fitting in of the block body 8 into the recess 7. Therefore, production mistakes are less frequent and production costs can be greatly reduced.

Figure 5:
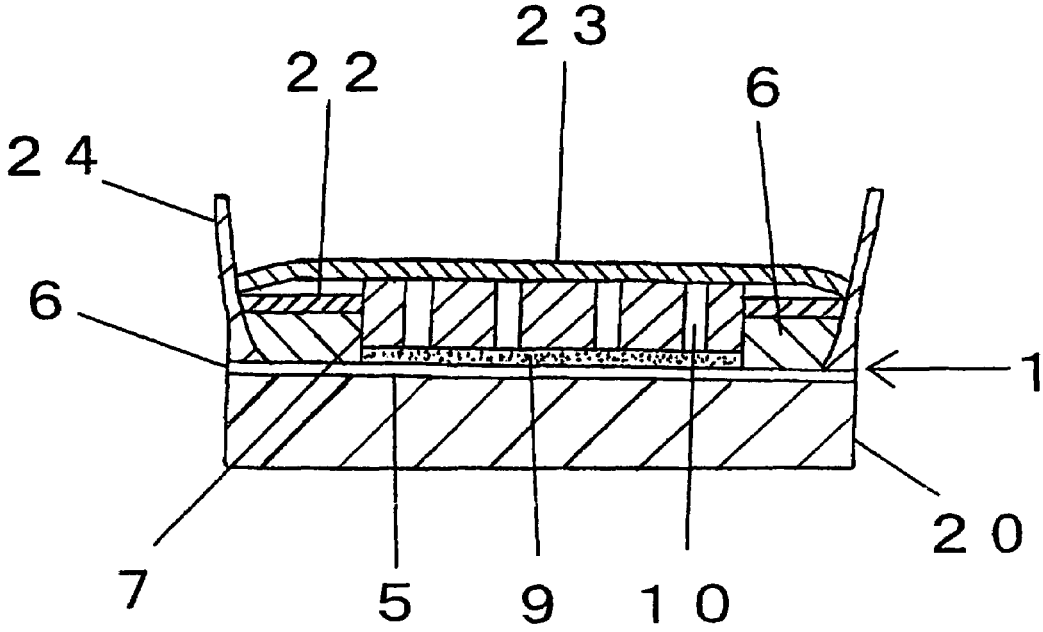
FIG. 5 illustrates a transverse cross-section view of a sole of another embodiment.

An air-permeable shoe of another embodiment is shown in FIG. 5. This air-permeable shoe is used, for example, for training shoes and sneakers. The sole 1 has a two-layer structure comprising an outsole 20 and midsole 21. An insole 22 and cup insole 23 are respectively stacked on the sole 1 upper surface. The block body 8 and support sheet 9 are the same as in the above embodiment.

The outsole 20 and midsole 21 are made of the same rubber. The upper surface of the outsole 20 is formed in a depressed shape and peripheral walls 24 are formed on the peripheral edges. The midsole 21 is formed in a shape similar to the contour of the outsole 20, and fitted in and adhered to the recess, thereby forming the sole 1 in which the outsole 20 and midsole 21 are integrated.

On the upper surface of the outsole 20, transverse grooves 5 identical to those in the above embodiment are formed.

The vent holes 6 penetrating the peripheral walls 24 are formed so as to communicate with the transverse grooves 5. The toe tip side and heel side of the midsole 21 are both made partially hollow, the midsole 21 is stacked on the outsole 20, and the transverse grooves 5 are partly covered with the midsole 21.

The insole 22 is a standard insole, made of rubber, leather or the like. As with the midsole 21, the insole 22 is made partially hollow. More specifically, the insole 22 has the same shape as the midsole 21. The insole 22 is stacked on the midsole 21 upper surface, and the midsole 21 and insole 22 together form the recess 7 reaching the outsole 20. In the recess 7, the support sheet 9 is fitted, and the block body 8 is fitted thereon. The upper portions of the block body 8 protrude above the insole 22 upper surface.

The cup insole 23 has a standard structure made of an elastic material such as sponge. For the outer material of the cup insole 23, fibers coated with silver or other metal ions are used, making it antibacterial.

In this air-permeable shoe as well, air flows in and out between outside and inside of the shoe, thereby ventilating the shoe interior.

The above described embodiments should not be construed as limiting, and various other modifications may be made in the present invention without departing from the scope thereof. An air-permeable shoe can be used for business shoes, sneakers, sandals and boots, and is suitable for footwear to be worn at hospital, school, office, shop and other indoor places.

The sole of the above air-permeable shoe has a two-layer structure. Alternatively, in the case of a one-layer structure, a recess is formed on the sole upper surface, and transverse grooves are formed on the recess bottom surface. Vent holes directed from the lateral surfaces of the sole to the recess are formed so that the vent holes communicate with the transverse grooves. The constitutions of the other elements are the same as described above.

The upper surfaces of the block body may be configured so as to be uneven, thereby stimulating the undersurface of the foot and improving the massaging effect. Alternatively, transverse grooves may be formed across the upper surface of the lower sole, and the recess in which the block body is fitted may be provided not only on the two sections of front and back but also on a plurality of other sections.

DESCRIPTION OF THE LEGENDS

1 Sole
2 Upper
3 Upper sole
4 Lower sole
5 Transverse grooves
6 Vent holes
7 Recess
8 Block body
9 Support sheet
10 Vertical holes
20 Outsole
21 Midsole
22 Insole
23 Cup insole
24 Peripheral walls

What is claimed:

1. An air-permeable shoe having an interior, comprising a sole with lateral surfaces, a recess formed on a sole upper surface, transverse grooves formed on a recess bottom surface, the transverse grooves communicating with vent holes formed on the lateral surfaces of the sole, an elastic block body fitted in the recess, upper portions of a block body protruding above the sole upper surface, vertical holes formed in the block body on the bottom surface of the recess, a support sheet provided so that when a load is applied, entry of the block body into the transverse grooves is prevented, the support sheet being air permeable, the shoe interior and transverse grooves communicating with one another through the vertical holes and support sheet, and when a load is applied to the block body, the vertical holes deform, thereby causing air to flow in and out between the vent holes and shoe interior.

2. An air-permeable shoe having a shoe interior comprising a two-layer structure sole having an upper sole and lower sole, transverse grooves formed on an upper surface of the lower sole, the transverse grooves reaching lateral surfaces of the lower sole, a recess formed on the upper sole which penetrates so as to reach the lower sole, an elastic block body is fitted in the recess, upper portions of the block body protruding above the upper sole upper surface, vertical holes formed in the block body, a support sheet provided on the recess so that when a load is applied, entry of the block body in the transverse grooves is prevented, the support sheet being air permeable, the shoe interior and transverse grooves communicating with one another through the vertical holes and support sheet, and when a load is applied to the block body, the vertical holes deform, thereby causing air to flow in and out through the transverse grooves.

3. An air-permeable shoe having a shoe interior comprising a two-layer structure sole having an outsole in which an upper surface is formed in a depressed shape to form peripheral walls on peripheral edges thereof and a midsole fitted in such depression, transverse grooves formed on the outsole, the transverse grooves penetrating peripheral walls and reaching lateral surfaces of the sole to serve as vent holes, a recess on the midsole that penetrates so as to reach the outsole, an elastic block body fitted in the recess, upper portions of the block body protruding above an midsole upper surface, vertical holes formed in the block body, a support sheet provided in the recess so that when a load is applied, entry of the block body in the transverse grooves is prevented, the support sheet being air permeable, the shoe interior and transverse grooves communicating with one another through the vertical holes and support sheet, and when a load is applied to the block body, the vertical holes deform, thereby causing air to flow in and out through the transverse grooves.

4. An air-permeable shoe according to any of claims 1, 2 or 3, wherein a plurality of transverse grooves are formed so as to intersect with one another, and a vent path is formed in the horizontal direction in the support sheet so that a plurality of vertical holes and transverse grooves communicate with one another.

5. An air-permeable shoe according to any of claim 1, 2, or 3, wherein the recess has a set size regardless of the sole size, and the block body has a set shape corresponding to the recess.

* * * * *